US005474040A

United States Patent [19]

Murakami et al.

[11] Patent Number: 5,474,040

[45] Date of Patent: Dec. 12, 1995

[54] CYLINDER BLOCK FOR AN INTERNAL COMBUSTION ENGINE

[75] Inventors: Hiroaki Murakami; Kazuyuki Fukuhara, both of Toyota, Japan

[73] Assignee: Toyota Jidosha Kabushiki Kaisha, Toyota, Japan

[21] Appl. No.: 234,080

[22] Filed: Apr. 28, 1994

[30] Foreign Application Priority Data

Jun. 7, 1993 [JP] Japan ..... 5-136273

[51] Int. Cl.[6] ..... F02F 7/00

[52] U.S. Cl. ..... 123/195 R; 123/41.74; 123/193.2

[58] Field of Search ..... 123/195 R, 41.74, 123/193.2

[56] References Cited

FOREIGN PATENT DOCUMENTS

| | | |
|---|---|---|
| 2609501 | 7/1988 | France . |
| 3741838 | 6/1988 | Germany . |
| 55-046066 | 3/1980 | Japan . |
| 25924846 | 7/1984 | Japan . |
| 60-84748 | 6/1985 | Japan . |
| 2201197 | 8/1988 | United Kingdom . |

*Primary Examiner*—Noah P. Kamen
*Attorney, Agent, or Firm*—Kenyon & Kenyon

[57] ABSTRACT

A cylinder block for an internal combustion engine includes a bolt boss located between cylinders, the bolt boss being connected to a common wall portion of a siamese bore wall structure by a double bridge structure including a lower bridge and an upper bridge located above the lower bridge. Since a composite moment $E_0$ acting on the bolt boss during the tightening of a head bolt is directed in a plane including the common wall portion, the composite moment can be born by the common wall portion which has a very large rigidity in a direction perpendicular to the row of cylinder bores. As a result, deformation of the bolt boss is suppressed, and deformation of the cylinder bore and inclination of the top deck are also effectively suppressed.

11 Claims, 5 Drawing Sheets

$W_1 > W_2 \fallingdotseq D$ $l_1 \geqq l_2$ $\alpha < \beta$

CYLINDER BLOCK FOR AN INTERNAL COMBUSTION ENGINE

BACKGROUND OF THE INVENTION

1. Field of the Invention

The present invention relates to a cylinder block for an internal combustion engine, and more particularly, to a cylinder block structure capable of suppressing deformation of a cylinder bore and a gasket seal surface caused when fastening a cylinder head to the cylinder block.

2. Description of the Related Art

In conventional internal combustion engines as illustrated in FIGS. 10, 11 and 12, when a cylinder head 52 is fastened to a closed deck-type cylinder block 51 with a head bolt 53, a bolt boss 56 is pulled upwardly. This causes a moment $E_1$, $E_2$ about a rigid grommet 55 of a head gasket 54 in a plane connecting a bore center and a bolt center and, consequently causes deformations of the cylinder bore wall 57 and an upper deck 55. In this instance, intermediate cylinder bores cause a fourth-mode deformation and end cylinder bores cause a third-mode deformation as shown by the dashed lines in FIG. 12. In addition, the upper deck 58 inclines inwardly and downwardly as shown in FIG. 10. The deformation of the cylinder bores increases oil consumption and piston slap noise.

To suppress the cylinder bore deformation, various proposals have been made. For example, Japanese Utility Model Publication SHO 59-24846 proposes a cylinder block shown in FIG. 13, wherein a cylinder block outside wall 61 and a common wall portion 62 of a siamese bore wall structure are connected via a single bridge structure 63 on a side of an oil-ring of a piston to thereby suppress the fourth-mode deformation of the cylinder bore near the oil-ring. No deck is provided above the single bridge structure to thereby cut transmission of a bending moment through the upper deck.

However, there are problems with the conventional cylinder block. More particularly, although the cylinder bore deformation is suppressed, the upper end surface 64 of the cylinder block outside wall is inclined seriously by the fastening force of the head bolts 65 to cause a sealing problem. When the bolt boss 67 is pulled upwardly relative to the common wall portion located between adjacent cylinder bores, the cylinder block outside wall 61 falls inwardly as shown in FIG. 14. As a result, a gap g is generated between an upper end surface of the common wall portion and a lower surface of the cylinder head 68, through which gas will blow-by between adjacent cylinders. Further, the inclination of the upper end surface of the cylinder block outside wall may cause leakage of cooling water and may decrease gasket durability.

SUMMARY OF THE INVENTION

An object of the invention is to provide a cylinder block for an internal combustion engine capable of suppressing deformation of a cylinder bore and inclination of an upper deck of the cylinder block.

The above-described object can be achieved by a cylinder block for an internal combustion engine in accordance with the invention, which includes a monolithic, siamese bore wall structure defining a plurality of cylinder bores therein arranged in a row and in parallel with each other. The bore wall structure including a common wall portion located between adjacent cylinder bores. The common wall portion is used as a portion of cylinder bore walls for defining the adjacent cylinder bores; a cylinder block outside wall surrounding the bore wall structure with a space for a water jacket left between the cylinder block outside wall and the bore wall structure, the cylinder block outside wall including a bolt boss on each side of the common wall portion of the bore wall structure in a direction perpendicular to the row of the cylinder bores, the bolt boss including a bolt hole formed therein having a threaded portion at a lower portion of the bolt hole. A double bridge structure connects the common wall portion of the bore wall structure and the cylinder block outside wall. The double bridge structure includes a lower bridge located at the same level as the threaded portion of the bolt hole formed in the bolt boss and an upper bridge located above the lower bridge.

Cylinder bore deformations which would cause a problem from the viewpoints of gas sealing and oil sealing are fourth- or higher-mode deformations. Second-mode and third-mode deformations can be followed by a piston-ring and an oil-ring and no problem will be caused. Therefore, fourth-mode deformation of the intermediate cylinder bores has to be suppressed.

Moments $E_1$ and $E_2$ acting on the bolt boss when the head bolt is tightened act in planes connecting the bolt hole center and the centers of the adjacent cylinder bores, and a composite moment $E_0$ of the moments $E_1$ and $E_2$ acts in a plane perpendicular to the row of the cylinder bores. Therefore, if the bending rigidity of the bolt boss in a direction perpendicular to the row of the cylinder bores is increased, the bolt boss will be prevented from deforming in the $E_0$ direction. At the same time, the deformations of the cylinder bores in the $E_1$ and $E_2$ directions will be decreased, and as a result, the fourth-mode deformation of the cylinder bore is suppressed.

Since the common wall portion of the bore wall structure is substantially a solid plate in the direction perpendicular to the row of the cylinder bores and therefore has a large bending rigidity in that direction, the common wall portion can be conceived as a rigid body in that direction.

In a cylinder block in accordance with the invention, since the bolt boss is connected to the rigid body of the common wall portion in the direction perpendicular to the row of the cylinder bores by means of the double bridge structure, the bending rigidity of the bolt boss located between cylinders is increased. As a result, the fourth-mode deformation of the intermediate cylinder bores can be decreased, and deformation of the upper deck is also decreased.

BRIEF DESCRIPTION OF THE DRAWINGS

The above-described object and other objects, features, and advantages of the present invention will become more apparent and will be more readily appreciated from the following detailed description of the preferred embodiments of the invention taken in conjunction with the accompanying drawings, in which.

DETAILED DESCRIPTION OF THE PREFERRED EMBODIMENTS

Figure 1:
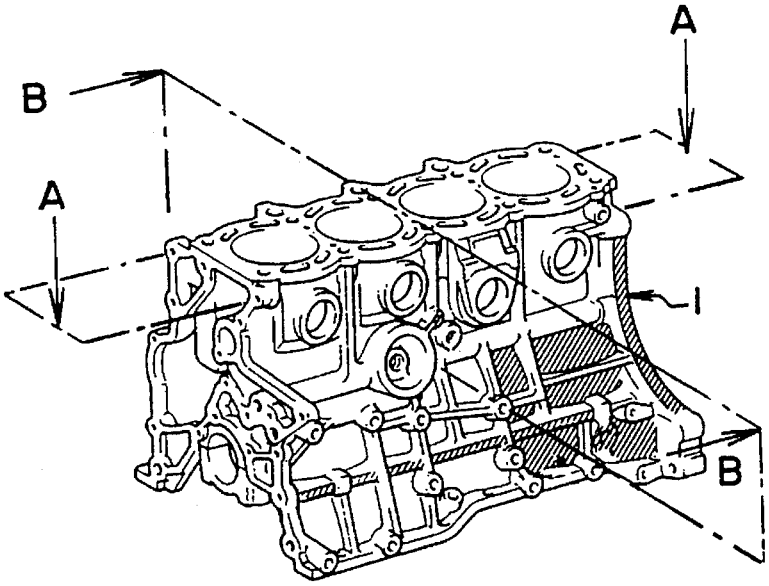
FIG. 1 is an oblique view of a cylinder block for an internal combustion engine in accordance with a first embodiment of the present invention.

FIGS. 1–5 illustrate a first embodiment of the invention.

In FIGS. 1–5, a cylinder block 1 for an internal combustion engine is, for example, a cylinder block of a four-cylinder engine. The cylinder block 1 includes a monolithic, siamese bore wall structure 2 and a cylinder block outside wall 3 surrounding the bore wall structure 2 with a space for a water jacket between the bore wall structure 2 and the cylinder block outside wall 3. The bore wall structure 2 defines a plurality of cylinder bores which are arranged in a row and in parallel with each other. The bore wall structure 2 includes a plurality of independent bore wall portions 4 and a common wall portion 5 located between adjacent cylinder bores and commonly used (thus, called siamese) as a portion of cylinder bore walls for defining the adjacent cylinder bores. The cylinder block outside wall 3 includes bolt bosses 6 located at the four corners of a rectangle having its center at a center of the cylinder bore. Bolt bosses located between adjacent cylinders are commonly used for the two adjacent cylinders. A bolt hole 7 is formed in each bolt boss 6. The common wall portion 5 extends in a direction perpendicular to the row of the cylinder bores. The bolt bosses 6 between adjacent cylinders and the centers of the bolt holes 7 formed in the bolt bosses 6 between adjacent cylinders are located on opposite sides of the common wall portion 5 in the direction perpendicular to the row of the cylinder bores. The bolt hole 7 includes a counter bore portion 8 (a non-threaded portion) and a threaded portion 9 located below the counter bore portion 8. In one side portion of the cylinder block outside of the bolt hole 7, a blow-by gas and oil passage 10 is formed.

Figure 2:
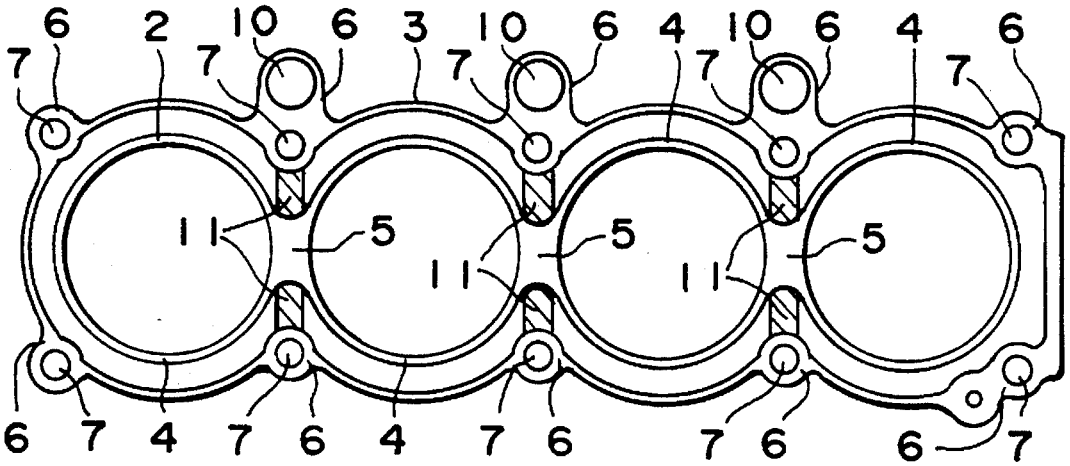
FIG. 2 is a cross-sectional view of the cylinder block of FIG. 1 taken along line A—A.
Figure 3:
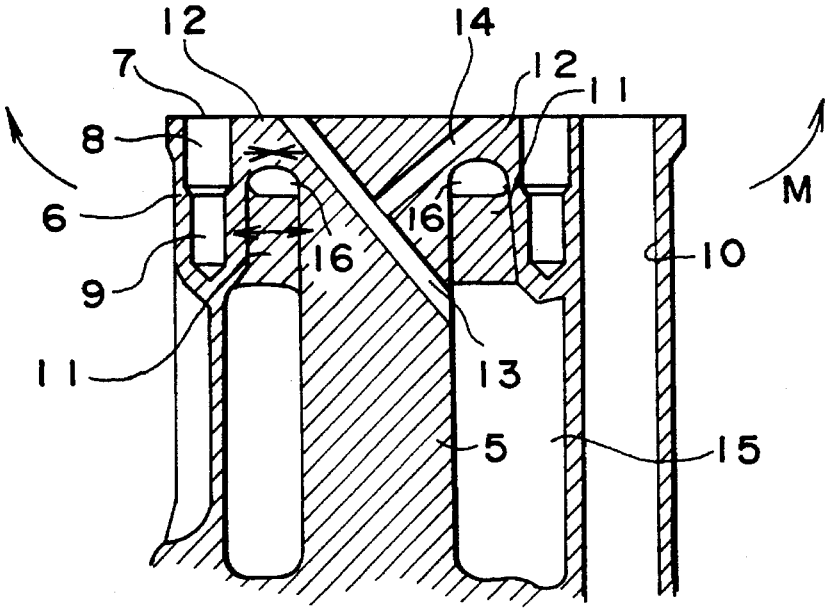
FIG. 3 is a cross-sectional view of the cylinder block of FIG. 1 taken along line B—B.
Figure 4:
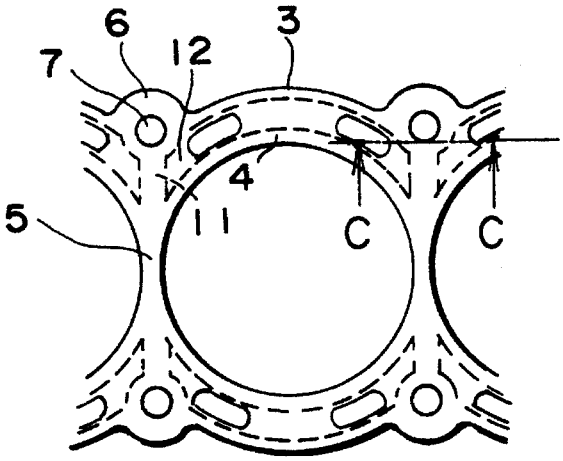
FIG. 4 is a partial plan view of the cylinder block of FIG. 1.

The common wall portion 5 of the bore wall structure 2 and the bolt bosses 6 located on an extension of a center line of the common wall portion 5 are connected via a double bridge structure. The double bridge structure includes a lower bridge 11 located at the same level as the threaded portion 9 of the bolt hole 7 and an upper bridge 12 located above the lower bridge 11. The lower bridge 11 extends in the direction perpendicular to the row of the cylinder bores. FIG. 2 illustrates the lower bridge 11 and FIG. 4 illustrates the upper bridge 12. FIG. 3 shows the common wall portion 5 which is located between the right and left lower bridges 11 and between the right and left upper bridges 12. The common wall portion 5 is a single solid plate. Therefore, the common wall portion 5 has a large bending rigidity and can be regarded as nearly a rigid body in the direction perpendicular to the row of the cylinder bores. Since an upper portion of the common wall portion 5 contacts combustion gas and is heated, cooling water passages 13 and 14 having small diameters may be formed in the common wall portion 5 for cooling the common wall portion 5. In FIG. 3, the cooling water passage 13 has one end opening to the water jacket 15 formed in the cylinder block and another end opening to a water jacket (not shown) formed cylinder head. The cooling water passage 14 extends from an intermediate portion of the cooling water passage 13 to the water jacket formed in the cylinder head. Since the cooling water passages 13 and 14 have small diameters, cooling water passages 13 and 14 only slightly decrease the bending rigidity of the common wall portion 5. In the first embodiment of the invention, as shown in FIG. 3, a space for a cooling water passage 16 remains between the upper and lower bridges 11 and 12, through which cooling water can smoothly flow. As a result, good cooling efficiency is maintained despite the provision of the lower bridges 11.

Figure 5:
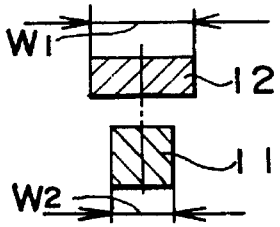
FIG. 5 is a cross-sectional view of a double bridge structure of the cylinder block of FIG. 4 taken along line C—C, illustrating a dimensional relationship between an upper bridge and a lower bridge.
Figure 8:
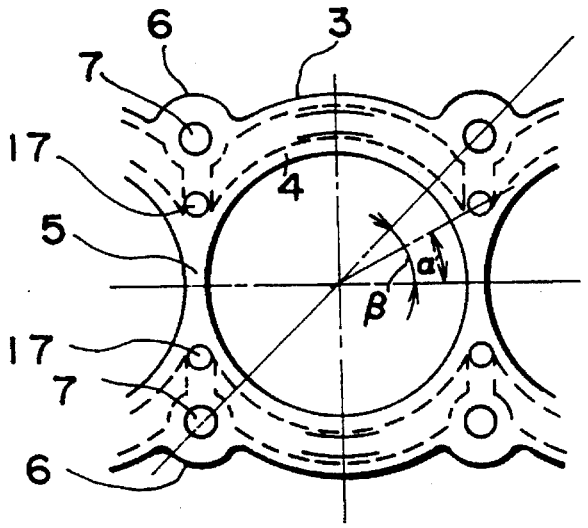
FIG. 8 is a partial plan view of the cylinder block of FIG. 7.

FIG. 5 illustrates a preferable dimensional relationship for the double bridge structure in the first embodiment of the invention. As illustrated in FIG. 5, a width $W_2$ of the lower bridge 11 is nearly equal to a thickness D of a smallest thickness portion of the common wall portion 5, and a width $W_1$ of the upper bridge 12 is greater than the width $W_2$ of the lower bridge 11. To satisfy this relationship between $W_1$ and $W_2$, as illustrated in FIG. 8, an angle alpha between a line passing through the bore center and a line connecting a bore center and a point where the lower bridge 11 joins with the same bore's wall structure 2 should be smaller than an angle beta between the line passing through the bore centers and a line connecting the bore center and a bolt hole center. Further, a second moment of area $I_1$ of the upper bridge 12 is selected to be greater than a second moment of area $I_2$ of the lower bridge 11.

The reasons for the above-described dimensional relationships will now be explained. Regarding that $W_2$ is nearly equal to D, if $W_2$ were much greater than D, a moment transmitted through the skin portions ($W_2$–D) of the lower bridge 11 might deform the cylinder bore. The reason that $W_1$ is greater than $W_2$ is to set $I_1$ to be greater than $I_2$. The reason $I_1$ is chosen to be greater than or equal to $I_2$ is that, when a bending moment acts as shown in FIG. 3, the moment will act on the upper bridge 12 more strongly than on the lower bridge because the upper bridge 12 is close to a moment center (a top deck portion around the bore). So the upper bridge 12 should have a great second moment of area and a great bending rigidity to bear the large bending moment. To increase $I_1$, it would be effective to increase a thickness of the upper bridge 12. However, if the thickness of the upper bridge 12 were increased, a temperature of the cylinder bore would increase, and resultantly, a temperature of the piston-ring groove portion when the piston comes to the top dead center position would increase. Since the piston temperature should be maintained relatively low, in the invention the width of the top bridge 12 is increased to increase $I_1$.

Operation of the first embodiment of the invention will now be explained.

Figure 10:
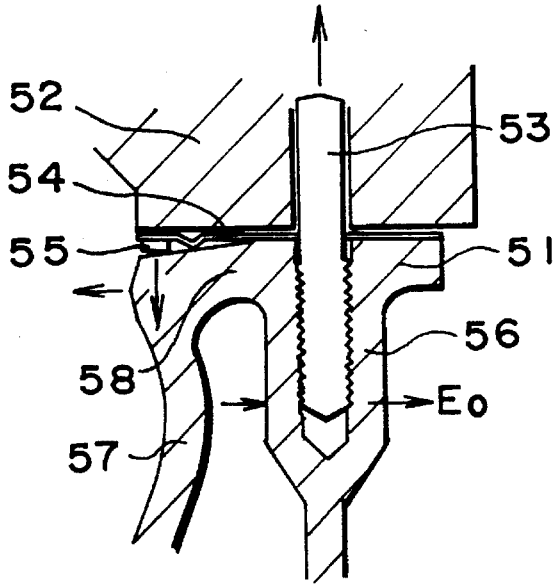
FIG. 10 (PRIOR ART)
FIG. 10 is a partial cross-sectional view of a conventional cylinder block illustrating deformations of a cylinder bore wall and a top deck when a head bolt is tightened.
Figure 11:
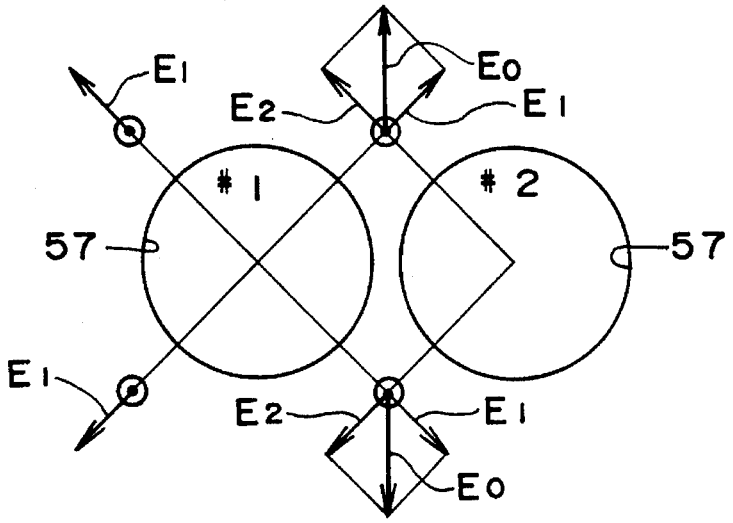
FIG. 11 (PRIOR ART)
FIG. 11 is a vector diagram of bending moments generated in the cylinder block of FIG. 10 when a head bolt is tightened.
Figure 12:
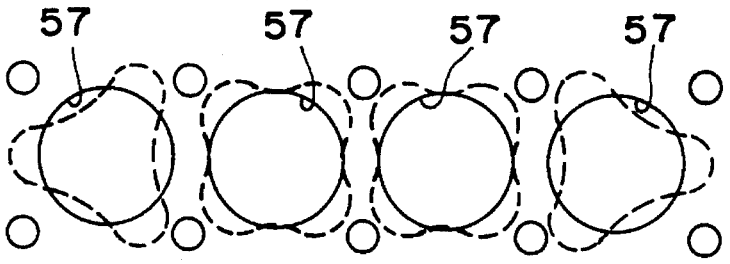
FIG. 12 (PRIOR ART)
FIG. 12 is a plan view of the cylinder block of FIG. 10 illustrating a deformation of the cylinder bore.
Figure 13:
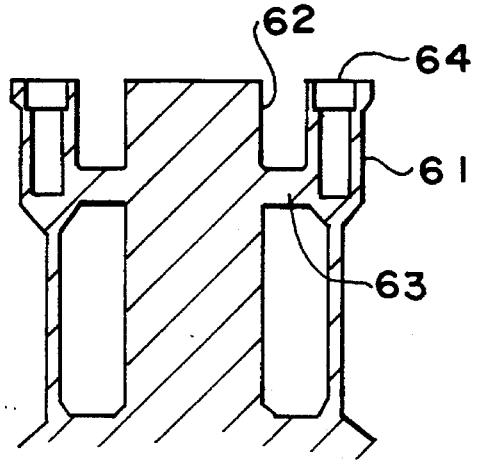
FIG. 13 (PRIOR ART)
FIG. 13 is a schematic, cross-sectional view of a cylinder block disclosed in Japanese Utility Model Publication SHO 59-24846.
Figure 14:
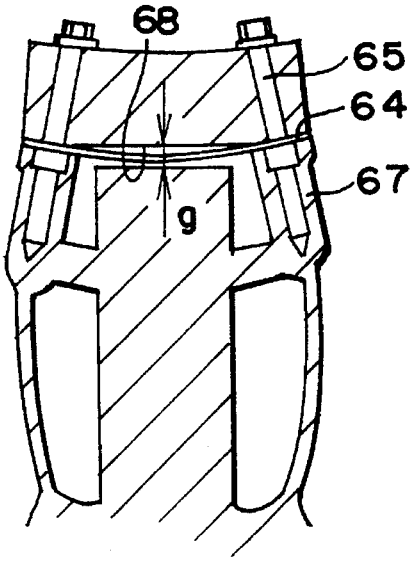
FIG. 14 (PRIOR ART)
FIG. 14 is a cross-sectional view of the cylinder block of FIG. 13 illustrating a deformation of the cylinder block when a head bolt is tightened.

As illustrated in FIG. 10, when the cylinder head is fastened to the cylinder block, bending moments $E_1$ and $E_2$ will be generated in the bolt bosses 6 located between adjacent cylinders due to the bolt axial force. As illustrated in FIG. 11, a composite moment $E_0$ of the bending moments $E_1$ and $E_2$ acts in the direction ($E_0$ direction) perpendicular to the rows of the cylinder bores. Since the bolt bosses 6 between cylinders are connected to the common wall portion 5, which is substantially rigid in the $E_0$ direction by the double-bridge structure, deformation of the bolt bosses 6 is suppressed. As a result, deformation of the bolt bosses 6 in the $E_1$ and $E_2$ directions is also suppressed, and deformation in the fourth-mode of the cylinder bore and inclination of the top deck will also be suppressed. As a result, oil consumption and piston slap sound due to the cylinder bore deformation are reduced. In addition, breakage of the gasket due to the inclination of the top deck is prevented. Further, gas blow-by between adjacent cylinders through a clearance generated between the lower surface of the cylinder head and the upper end surface of the common wall portion 5 will be prevented.

Figure 6:
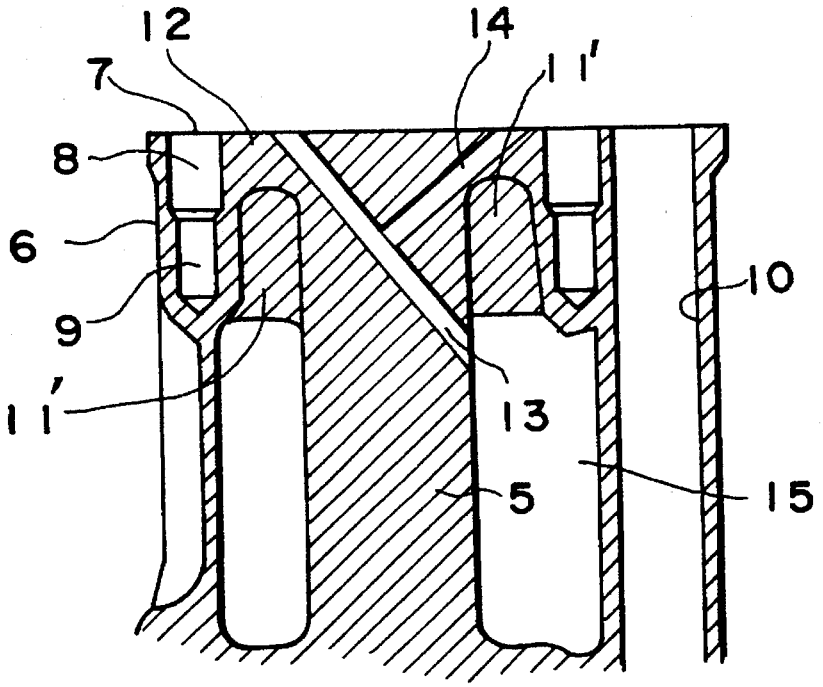
FIG. 6 is a cross-sectional view of a cylinder block for an internal combustion engine in accordance with a second embodiment of the present invention.

FIG. 6 illustrates a second embodiment of the invention. The second embodiment is different from the first embodiment in that a lower bridge 11' is integral with the upper bridge 12.

Extension of the lower bridge 11' up to the upper bridge 12 strengthens the connection of the bolt bosses 6 with the common wall portion 5. As a result, deformation of the cylinder bore and inclination of the top deck are further suppressed as compared with the first embodiment.

Other structures and operation of the second embodiment of the invention are the same as those of the first embodiment of the invention, and explanation on the same structures and operation will be omitted by denoting the same structural members with the same reference numerals as those of the first embodiment.

Figure 7:
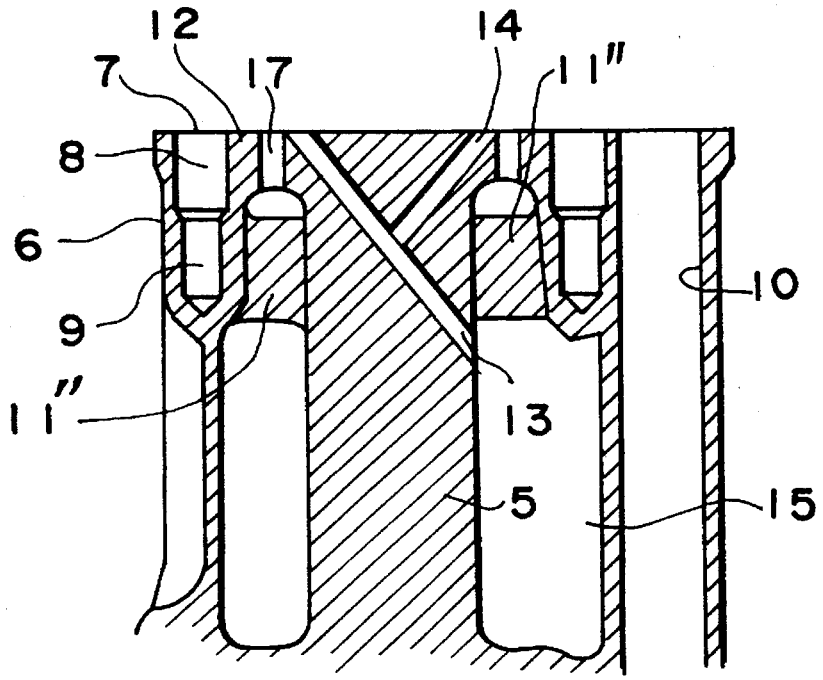
FIG. 7 is a cross-sectional view of a cylinder block for an internal combustion engine in accordance with a third embodiment of the present invention.
Figure 9:
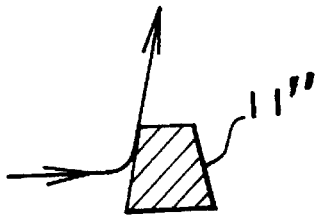
FIG. 9 is a cross-sectional view of the lower bridge of the cylinder block of FIG. 7.

FIGS. 7–9 illustrate a third embodiment of the invention. The third embodiment is different from the first embodiment in that a machined small diameter hole 17 is formed in the upper bridge 12 above the lower bridge 11". The machined small diameter hole 17 leads engine cooling water from the water jacket formed in a cylinder to a water jacket (not shown) formed in a cylinder head. In this instance, the diameter of the hole 17 should be selected so that the rigidity of the top deck is not seriously decreased. Provision of the hole 17 allows cooling water to smoothly flow in the water jacket formed in an upper portion of the cylinder block to improve cooling efficiency. In this instance, as illustrated in FIG. 9, a side surface of the lower bridge 11" may be tapered so as to change a water flow direction from a lateral direction (a horizontal direction) to an upward direction, toward the cylinder head. This further improves the cooling efficiency of the water jacket.

Other structures and operation of the third embodiment of the invention are the same as those of the first embodiment of the invention, and explanation on the same structures and operation will be omitted by denoting the same structural members with the same reference numerals as those of the first embodiment.

In accordance with the invention, the bolt bosses 6 formed in the cylinder block outside wall 3 are connected to the common wall portion 5 of the siamese bore wall structure 2 by the double bridge structure including the lower bridge 11, 11', 11" and the upper bridge 12. Thus, rigidity of the bolt bosses 6 can be increased in the direction perpendicular to the rows of the cylinder bores. As a result, when a bending moment acts on the bolt bosses 6 as a head bolt is tightened, deformation of the bolt bosses 6 is well suppressed, and deformation of the cylinder bore in the fourth mode and inclination of the top deck are also effectively suppressed. As a result, various advantages such as reduction of oil consumption, decrease in piston slap, improved head gasket durability, suppression of gas blow-by between cylinders, and decreased noise radiation from the cylinder block are obtained.

Although only three embodiments of the invention have been described in detail above, it will be appreciated by those skilled in the art that various modifications and alterations can be made to the particular embodiments shown without materially departing from the novel teachings and advantages of the present invention. Accordingly, it is to be understood that all such modifications and alterations are included within the spirit and scope of the present invention as defined by the following claims.

What is claimed is:

1. A cylinder block for an internal combustion engine comprising:

a monolithic, siamese bore wall structure defining a plurality of cylinder bores therein, the cylinder bores being arranged in a row and in parallel with each other, the bore wall structure including a common wall portion located between adjacent cylinder bores;

a cylinder block outside wall surrounding the bore wall structure, the cylinder block outside wall including a space for a water jacket between the cylinder block outside wall and the bore wall structure, the cylinder block outside wall further including a bolt boss on each side of the common wall portion of the bore wall structure in a direction perpendicular to the row of the cylinder bores, each bolt boss including a bolt hole formed therein, each bolt hole having a lower threaded portion; and a double bridge structure connecting the common wall portion of the bore wall structure and the cylinder block outside wall, the double bridge structure including a lower bridge located at substantially the same level as the threaded portions of the bolt holes formed in the bolt bosses and an upper bridge located above the lower bridge, wherein the upper bridge and the lower bridge are separated by a space which forms a portion of the cooling water jacket.

2. A cylinder block for an internal combustion engine according to claim 1, wherein the common wall portion of the bore wall structure extends in the direction perpendicular to the row of the cylinder bores so as to have a large bending rigidity in a plane perpendicular to the row of the cylinder bores.

3. A cylinder block for an internal combustion engine according to claim 1, wherein the upper bridge and the lower bridge extend in the direction perpendicular to the row of the cylinder bores.

4. A cylinder block for an internal combustion engine according to claim 1, wherein the common wall portion of the bore wall structure includes a cooling water passage formed in an upper portion of the common wall portion at which the common wall portion contacts combustion gas.

5. A cylinder block for an internal combustion engine according to claim 4, wherein the cooling water passage includes one end opening to the water jacket formed in the cylinder block and another end opening to a water jacket formed in a cylinder head.

6. A cylinder block for an internal combustion engine according to claim 1, wherein the lower bridge has a width approximately equal to a width of the common wall portion of the bore wall structure.

7. A cylinder block for an internal combustion engine according to claim 1, wherein the upper bridge has a width greater than a width of the lower bridge.

8. A cylinder block for an internal combustion engine according to claim 1, wherein the upper bridge has a second moment of area greater than a second moment of area of the lower bridge.

9. A cylinder block for an internal combustion engine according to claim 1, wherein the upper bridge and the lower bridge are integrally connected to each other.

10. A cylinder block for an internal combustion engine according to claim 1, wherein the upper bridge has a hole formed therein above the lower bridge for allowing cooling water to flow therethrough.

11. A cylinder block for an internal combustion engine according to claim 10, wherein the lower bridge has a tapered side surface for changing a water flow direction from a lateral direction to an upward direction.

* * * * *